US011384661B2

(12) United States Patent
Lahr

(10) Patent No.: US 11,384,661 B2
(45) Date of Patent: Jul. 12, 2022

(54) VALVE TRAIN FOR AN INTERNAL COMBUSTION ENGINE OF A MOTOR VEHICLE

(71) Applicant: Daimler AG, Stuttgart (DE)

(72) Inventor: Matthias Lahr, Schwaebisch Gmuend (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/755,473

(22) PCT Filed: Sep. 21, 2018

(86) PCT No.: PCT/EP2018/075629
§ 371 (c)(1),
(2) Date: Apr. 10, 2020

(87) PCT Pub. No.: WO2019/072523
PCT Pub. Date: Apr. 18, 2019

(65) Prior Publication Data

US 2020/0340372 A1 Oct. 29, 2020

(30) Foreign Application Priority Data

Oct. 13, 2017 (DE) ..... 10 2017 009 541.8

(51) Int. Cl.
*F01L 1/047* (2006.01)
*F01L 1/18* (2006.01)
(Continued)

(52) U.S. Cl.
CPC ..... *F01L 1/047* (2013.01); *F01L 1/18* (2013.01); *F01L 1/22* (2013.01); *F01L 1/26* (2013.01); *F01L 13/06* (2013.01); *F01M 9/10* (2013.01)

(58) Field of Classification Search
CPC ..... F01L 1/047; F01L 1/46; F01L 1/18; F01L 1/22; F01L 1/26; F01L 1/182;
(Continued)

(56) References Cited

U.S. PATENT DOCUMENTS 6,314,926 B1 * 11/2001 Meneely ..... F01L 13/06 123/320
6,318,315 B1 11/2001 Harada et al.
(Continued)

FOREIGN PATENT DOCUMENTS

CN 1245245 A 2/2000
CN 101861449 A 10/2010
(Continued)

OTHER PUBLICATIONS

PCT/EP2018/075629, International Search Report dated Dec. 10, 2918 (Two (2) pages).
(Continued)

*Primary Examiner* — Devon C Kramer
*Assistant Examiner* — Kelsey L Stanek
(74) *Attorney, Agent, or Firm* — Crowell & Moring LLP

(57) ABSTRACT

A valve train includes a camshaft which has a cam group having a firing cam and a braking cam. A first cam follower is assigned to the firing cam with the first cam follower being provided in a firing mode for actuating a gas exchange valve. A second cam follower is assigned to the braking cam which is provided in a braking mode for actuating the gas exchange valve. A changeover device is provided to changeover between the firing mode and the braking mode. The camshaft has a separate switching cam which, in at least one operating mode, is provided to act directly on a switching element of the changeover device and which is provided for a direct changeover between the firing mode and the braking mode.

11 Claims, 13 Drawing Sheets

(51) Int. Cl.

| | |
|---|---|
| ***F01L 1/22*** | (2006.01) |
| ***F01L 1/26*** | (2006.01) |
| ***F01L 13/06*** | (2006.01) |
| ***F01M 9/10*** | (2006.01) |

(58) Field of Classification Search
CPC ... F01L 1/053; F01L 1/08; F01L 13/06; F01L 13/0036; F01L 13/065; F01L 13/08; F01L 2001/186; F01L 2001/0473; F01L 2105/00; F01M 9/10
USPC ..... 123/90.11, 90.15–90.17
See application file for complete search history.

(56) References Cited

U.S. PATENT DOCUMENTS

| | | | | |
|---|---|---|---|---|
| 7,533,640 | B2 | 5/2009 | Hahn et al. | |
| 10,731,526 | B2 * | 8/2020 | Lahr | F01L 13/065 |
| 2005/0247278 | A1 * | 11/2005 | Koshimizu | F01L 13/0063 123/90.16 |
| 2009/0071436 | A1 * | 3/2009 | Dietrich | F01L 13/065 123/321 |
| 2009/0159027 | A1 | 6/2009 | Nakamura | |
| 2010/0288229 | A1 | 11/2010 | Lancefield et al. | |
| 2014/0251266 | A1 * | 9/2014 | Emmons | F01L 13/065 123/321 |
| 2016/0298508 | A1 * | 10/2016 | Lahr | F01L 13/06 |
| 2018/0142585 | A1 | 5/2018 | Lahr | |
| 2019/0055858 | A1 * | 2/2019 | Bogdanski | F01L 13/0036 |

FOREIGN PATENT DOCUMENTS

| | | | | |
|---|---|---|---|---|
| CN | 104514589 | A | 4/2015 | |
| CN | 105612317 | A | 5/2016 | |
| CN | 105723055 | A | 6/2016 | |
| CN | 105899770 | A | 8/2016 | |
| CN | 106460578 | A | 2/2017 | |
| CN | 107060942 | A | 8/2017 | |
| DE | 103 37 430 | A1 | 3/2005 | |
| DE | 10 2013 019 000 | A1 | 5/2015 | |
| DE | 10 2014 008 378 | A1 | 12/2015 | |
| DE | 10 2015 009 877 | A1 | 2/2017 | |
| EP | 1279797 | A1 * | 1/2003 | F01L 1/146 |
| GB | 622057 | | 4/1949 | |
| WO | WO 2017/016825 | A1 | 2/2017 | |

OTHER PUBLICATIONS

German Search Report issued in German application No. 10 2017 009 541.8 dated Jun. 26, 2018, with Statemerit of Relevancy (Eight (8) pages).

Chinese Office Action issued in Chinese application No. 201880066376.9 dated May 19, 2021, with English translation (Sixteen (16) pages).

* cited by examiner

VALVE TRAIN FOR AN INTERNAL COMBUSTION ENGINE OF A MOTOR VEHICLE

BACKGROUND AND SUMMARY OF THE INVENTION

The invention relates to a valve train for an internal combustion engine of a motor vehicle, in particular a commercial vehicle.

From DE 10 2013 019 000 A1, a valve train having at least one camshaft is already known, which has at least one cam group having at least one firing cam and at least one braking cam, having at least one cam follower assigned to the firing cam, which is provided in a firing mode for actuating at least one gas exchange valve, and a cam follower assigned to the braking cam, which is provided in a braking mode for actuating the at least one gas exchange valve, and having a changeover device which is provided for changing over between the firing mode and the braking mode. The changeover device is provided for converting a torque of the camshaft into a force for changing over between the firing mode and the braking mode.

The known design of the valve train represents a purely mechanical changing over between two different valve lifts. The cam followers are functionally assigned to a specific valve lift, i.e., one cam follower for the fired lift and another for the brake lift. The mounting of the cam followers occurs on a common rocker arm axis, which is also rotatably mounted in the engine housing. The cam followers themselves are mounted on this axis with a central offset in relation to the axis of rotation of the rocker arm axis, such that it results in a movement of the rocker arm central axes relative to the camshaft axis when the rocker arm axis is rotated. This rotation causes an opposite movement of the rocker arm bearings such that they come into contact with the camshaft alternatively. A changeover between different valve lifts is thereby achieved, which are independent of each other and do not have to have a common base circle phase.

The synchronous rotation of the rocker arm axis at a specific control point in time is caused by the cam lift of a cam follower itself, i.e., the bearing force generates a corresponding adjustment torque on the rocker arm axis by which it is rotated accordingly. Since the cam elevation is continuous, the rocker arm shaft is also adjusted harmoniously and continuously. In addition, the adjustment takes place at the same time interval in which a regular valve lift would take place. Changing over between both cam profiles occurs by unlocking the end positions of the rocker arm shaft. In the case of a triggered unlocking, a rotation takes place during the next cam lift, the rotation being carried out until the opposite end position is reached and the locking is automatically arrested again.

The triggering of the switching operation, i.e., the unlocking of the rocker arm axis, is ensured by a camshaft-synchronous triggering device. This is constructively designed in such a way that the control point in time for the switching back and forth is shifted along the length of the half cam lift. It is thereby achieved that, when switching from the fired mode, the opening edge of the switching cam of a valve lift used as such causes the rocker arm axis to rotate into the braking mode and, corresponding to the switching-back, the closing edge of the same switching cam of a valve lift used as such causes the rotation back into the fired mode, wherein either the cam lift of the brake profile or a return spring here causes the corresponding torque on the rocker arm axis.

The object of the invention is in particular to provide an advantageously flexible and reliable valve train.

The invention is based on a valve train having at least one camshaft, which has at least one cam group having at least one firing cam and at least one braking cam, having at least one cam follower assigned to the firing cam, which is provided in a firing mode for actuating at least one gas exchange valve, and a cam follower assigned to the braking cam, which is provided in a braking mode for actuating the at least one gas exchange valve, and having a changeover device, which is provided to changeover between the firing mode and the braking mode.

It is provided that the camshaft has a separate switching cam which, in at least one operating condition, is provided to act directly on a switching element of the changeover device, which is provided for a direct changeover between the firing mode and the braking mode. Preferably, the changeover device is provided to convert a torque of the camshaft into a force for changeover between the firing mode and the braking mode. In this way, the torque and/or the rotational movement of the camshaft can be used, whereby an actuator which provides the force for the changeover, for example in the form of hydraulic pressure, can be dispensed with. Preferably, the switching element of the changeover device is provided for a direct switching between the firing mode and the braking mode to adjust a position of the cam followers. Preferably the switching element of the changeover device is provided for a direct changeover between the firing mode and the braking mode for adjusting the positions of the rotation axes of the cam followers. Preferably the switching cam is provided for an adjustment of the switching element and a related changeover between the firing mode and the braking mode for a direct contact of the switching element. Various designs of the switching element which appear sensible to a person skilled in the art are conceivable, such as a gear lever and/or a switching shaft, for example. Due to the design of the valve train according to the invention, a changeover between the firing mode and the braking mode independent of the firing cams and the braking cams can in particular be achieved. Due to the arrangement of the switching cam and the switching element, a kinematic coupling between the camshaft movement and the rotation of the independent changeover between the firing mode and the braking mode can in particular be produced. In particular, a targeted design of the independent changeover between the firing mode and the braking mode can be enabled. A "cam group" is to be understood to mean a group of cams which comprises all the cams provided for a cylinder of the internal combustion engine which the camshaft has. A "firing mode" is to be understood in particular as a control of the gas exchange valves for a fired mode. A "braking mode" is to be understood in particular as a control of the gas exchange valves for a braking mode in which a compression work within the cylinder is used for braking mode. The firing mode and the braking mode differ in particular in the control times for the gas exchange valves. In this context, a "changeover device" is to be understood in particular as a mechanism which is provided for a switching between the firing mode and the braking mode. The term "provided" is to be understood in particular as specially designed and/or equipped. Furthermore, in this context, a "separate switching cam" is to be understood in particular as a switching cam which is different from the firing cam and the braking cam, and is in particular independent. Preferably, the separate switching cam has at least one cam different from the firing cam and the braking cam.

It is also provided that the switching element of the changeover device is formed by a switching eccentric shaft. In particular, an advantageously reliable design of the switching element can be achieved. In particular, a switching element can be provided by means of which an advantageously high changeover force can be applied. Preferably, a changeover force can advantageously be set via an eccentricity. In particular, an advantageously versatile switching element can be provided. In this context, a "switching eccentric shaft" is to be understood in particular as a switching shaft which has at least one switching section which is eccentric relative to a mounting axis of the switching shaft. Preferably, the eccentric switching section is designed like a crankshaft. Preferably, the switching eccentric shaft also has at least one switching cam, which is provided for adjusting the switching eccentric shaft. Particularly preferably, the switching eccentric shaft is adjusted via the at least one switching cam, wherein the switching eccentric shaft is in turn provided to further transmit a switching movement via the eccentric switching section. In principle, it would also be conceivable that the switching eccentric shaft has several eccentric switching sections, wherein one of the eccentric switching sections is provided to adjust the switching eccentric shaft.

Furthermore, it is provided that the switching cam of the camshaft is designed to be axially moveable relative to the firing cam and the braking cam and forms a separate cam contour. Preferably, the separate cam contour is formed by a contour of the switching cam. Particularly preferably, the at least one switching cam has at least two switching positions, wherein a first switching position is assigned to a firing mode and a second switching position is assigned to a braking mode. One switching position is defined in particular by a defined position relative to the firing cam and the braking cam. In this way, an advantageously quick changeover between the firing mode and the braking mode can in particular be achieved. In particular, an advantageously direct changeover can be achieved. In addition, an advantageously simple changeover can be achieved, in particular if a switching position is assigned to each operating state.

It is further suggested that the changeover device has a rocker arm bearing directly coupled to the switching element, which has a first end position assigned to a firing mode and a second end position assigned to a braking mode. Preferably, the switching element, in particular the eccentric switching section, is guided in a groove, in particular in a slot, of the rocker arm bearing. This means that the changeover device can be designed in a particularly simple mechanical manner. By means of such a design, it can be achieved that the end position of the rocker arm bearing determines whether the firing mode or the braking mode is switched, whereby, for switching over, only the rocker arm bearing has to be switched from one end position to the other end position. In this way, the changeover can be easily implemented mechanically without the changeover device needing an additional actuator, whereby a simple and robust changeover device is needed. A "rocker arm bearing" is to be understood here in particular as a bearing for rocker arms for actuating the gas exchange valves, which is provided to absorb and dissipate actuating forces acting on the rocker arms when the gas exchange valves are actuated.

It is further provided that the valve train has at least two rocker arms, each of which has one of the cam followers, which can each be swivelled about a rocker arm axis determined by the rocker arm bearing to actuate the at least one gas exchange valve. Preferably the rocker arms are provided for direct actuation of the at least one gas exchange valve. By connecting the rocker arms to the rocker arm bearing, which can be switched between the first end position and the second end position, it can be achieved that, depending on the end position, the one rocker arm or the other rocker arm is in operative connection with the camshaft, whereby it is possible to switch easily between the firing mode and the braking mode.

In addition, it is provided that the rocker arm bearing has at least one bearing screw, having a ball head to a bearing that can be pivoted about the rocker arm axis of at least one of the rocker arms. Preferably the at least one bearing screw is formed by a spherical head screw. Preferably a geometrical center of the ball head defines the rocker arm axis. Particularly preferably, the ball head of the bearing screw together with a ball head receiver of the of the assigned rocker arm forms a ball joint by means of which the corresponding rocker arm is mounted on the rocker arm bearing. In particular, the bearing screw is screwed into a base body of the rocker arm bearing, wherein a screw-in depth can be changed. In this way, an advantageously flexible mounting of at least one of the rocker arms can in particular be provided. Preferably, a bearing can in particular be provided which can be used to compensate for advantageous tolerances. Furthermore, this can be used to achieve an advantageously simple assembly.

It is further provided that the rocker arm bearing has at least one rotatably mounted bearing element to receive the at least one bearing screw, wherein the bearing screw is designed to be moveable to a limited extent relative to the bearing element for adjusting the valve clearance. Preferably the rotatably mounted bearing element forms a base body of the rocker arm bearing. In particular, the bearing element is mounted so as to be rotatable relative to a housing. Preferably the at least one bearing screw is screwed into the bearing element, in particular into an internal thread of the bearing element. Particularly preferably, a valve clearance can be adjusted by changing a screw-in depth of the bearing bolt. In this way, an advantageously simple and flexible adjustment of the valve clearance can in particular be achieved. In particular, a constructively simple adjustment of the valve clearance can be achieved.

Furthermore, it is provided that the at least one bearing element of the rocker arm bearing has a switching gate in which an eccentric switching section of the switching element of the changeover device is guided. Preferably, the switching gate is formed in particular by an elongated recess in which an eccentric shifting section of the shifting element is guided. Preferably, a switching movement, in particular a switching rotation, of the switching element is transmitted to the bearing element via the switching gate. In this way, the changeover device can be designed mechanically in a particularly simple manner. By means of such a design, it can be achieved that the end position of the rocker arm bearing or the bearing element determines whether the firing mode or the braking mode is switched, whereby for changeover, only the rocker arm bearing must be switched from one end position to the other end position. In this way, the changeover can be simply implemented mechanically without the changeover device requiring an additional actuator, whereby a simply and robust changeover device is required.

It is further provided that the at least one bearing screw has at least one oil channel, which is provided to provide an engine-side pressure oil supply at the rocker arm depending on a position relative to the respective associated rocker arm.

Preferably, the oil channel is provided to provide an engine-side pressure oil supply at oil demand points of the rocker arm, such as the rocker arm roller or the slide shoe contact, depending on a position relative to the respective assigned rocker arm. Preferably, the oil channel ends at different points of the rocker arm depending on a position relative to the respectively assigned rocker arm. Preferably, the oil channel is connected to an oil channel of the rocker arm in at least one position relative to the respective assigned rocker arm. In particular, an advantageously reliable oil supply can be provided in this way. In particular, it can be advantageous to provide an oil supply that meets the requirements, in particular depending on an operating condition. In this context, an "oil channel" is to be understood in particular as a channel which is intended for carrying oil, in particular engine oil. Preferably, it should be understood as a channel through which oil, in particular engine oil, can be passively or actively guided through.

It is further provided that at least one of the rocker arms has at least one arresting element which is provided to arrest the rocker arm relative to the rocker arm bearing in at least one position. Preferably, the arresting element is in particular provided for arresting the rocker arm, in particular the rocker arm for a braking mode, in a firing mode. Preferably, the arresting element is provided for arresting the rocker arm to the ball head of the bearing screw. Particularly preferably, the arresting element is formed by a spring-loaded pressure piece, in particular spring-loaded balls. In principle, however, a different design, which would appear to make sense to a person skilled in the art, would also be conceivable. Preferably, the arresting device can be released non-destructively when a defined release force, which exceeds an arresting force, is applied. The arresting element is provided in particular to hold the rocker arm bearing in an end position. In this way, a reliable arresting can in particular be achieved.

It is also provided that the at least one arresting element is provided to stop an oil flow of the oil channel in an arrested state. Preferably, the arresting element is provided to directly cover the oil channel in an arrested state. Preferably, the arresting element is provided to engage in the oil channel of the bearing screw in an arrested state. In this way, a reliable disconnection of the oil flow can be achieved. In addition, the arresting element can in particular be used for several purposes. This in turn allows a number of components to be kept to a minimum.

Furthermore, the invention is based on a method for operating the valve train. It is provided that, for a direct changeover between the firing mode and the braking mode, a separate switching cam of a camshaft of the valve train acts directly on a switching element of the changeover device. This makes it possible, in particular, to achieve a changeover between the firing mode and the braking mode independent of the firing cam and the braking cam. In particular, the arrangement of the switching cam and the switching element makes it possible to establish a kinematic coupling between the camshaft movement and the rotation of the independent changeover between the firing mode and the braking mode. In particular, a targeted design of the independent changeover between the firing mode and the braking mode can be enabled.

Further advantages emerge from the following description of the Figures. In the Figures, an exemplary embodiment of the invention is depicted. The Figures, the description of the Figures and the claims contain numerous features in combination. Expediently, the person skilled in the art will also consider the features individually and combine them into further sensible combinations.

DETAILED DESCRIPTION OF THE DRAWINGS

Figure 1:
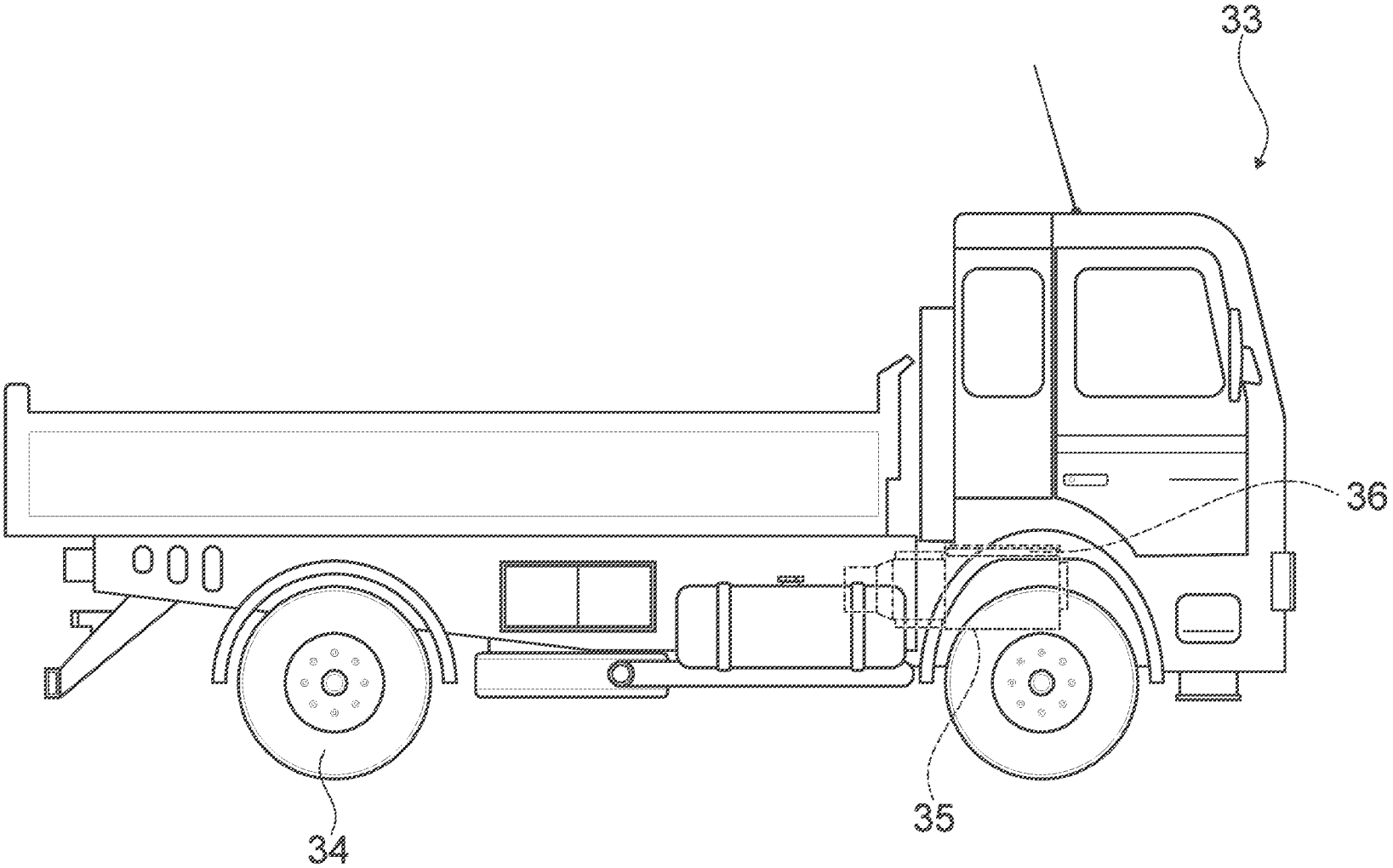
FIG. 1 is a schematic depiction of a motor vehicle having a valve train according to the invention.

FIG. 1 schematically shows a motor vehicle 33. The motor vehicle 33 is formed by a commercial vehicle, in particular a heavy goods vehicle (HGV). In principle, however, a different design of the motor vehicle 33 which appears sensible to a person skilled in the art would also be conceivable. The motor vehicle 33 comprises a drive train via which drive wheels 34 of a motor vehicle 33 are driven. The drive train comprises an internal combustion engine 35. In addition, the motor vehicle 33 has a multi-stage transmission which is not described in more detail. The internal combustion engine 35 has a driven crankshaft which is connected to a transmission input element of the multi-stage transmission. The multi-stage transmission forms part of the drive train of the motor vehicle 33. The internal combustion engine 35 comprises at least one valve train 36. Preferably, the internal combustion engine 35 comprises several valve trains 36. The internal combustion engine 35 is provided to convert chemical energy into kinetic energy, which is used in particular to propel a motor vehicle 33.

FIGS. 2 to 13 show the valve train 36 of the internal combustion engine 35. The valve train 36 comprises a camshaft 10, which is provided for a firing mode and a braking mode. The camshaft 10 is designed as an exhaust camshaft. The camshaft 10 is provided to actuate gas exchange valves 15, 16 for cylinders of the internal combustion engine 35 that are not depicted in more detail.

In the depicted exemplary embodiment, the internal combustion engine 35 comprises two gas exchange valves 15, 16 per cylinder, which are designed as exhaust valves. The camshaft 10 comprises at least one cam group having a firing cam 11 and a brake cam 12. The camshaft 10 comprises one cam group per cylinder for actuating the two gas exchange valves 15, 16. In the exemplary embodiment, only the firing cam 11 and the braking cam 12 of one cylinder are shown. Further cylinders which are not depicted in more detail have similarly designed cams.

Furthermore, the internal combustion engine 35 comprises at least one further gas exchange valve per cylinder, which is designed as an intake valve and is operated by an additional valve train. Preferably, two intake valves are provided for each cylinder, which are actuated by an intake camshaft. The further valve train and the intake valves are not depicted in more detail in the Figures.

The gas exchange valves 15, 16 and the intake valves are accommodated in the usual manner in a cylinder head of the internal combustion engine, which is not depicted in more detail.

The firing cam 11 is provided to open the gas exchange valves 15, 16 in a firing mode. The braking cam 12 is provided to open at least one of the gas exchange valves 15, 16 in a braking mode. The firing cam 11 and the braking cam 12 have different cam curves. The cam curve of the firing cam 11 has a lift which is provided in particular to open the gas exchange valves 15, 16, while a piston in the corresponding cylinder is moved from a bottom dead center to a top dead center in order to expel exhaust gas from the cylinder via the gas exchange valves 15, 16 in one expulsion stroke. The cam curve of the brake cam 12 is at least provided to open at least one of the gas exchange valves 15, 16, after the piston of the corresponding cylinder has been moved from the bottom dead center to the top dead center in order to release the compressed air or combustion air in a compression stroke via the at least one gas exchange valve 15, 16. The combustion air is let into the cylinder in an intake stroke via the inlet valves in an intake stroke before the compression stroke. The engine braking effect arises from the release of the compressed combustion air at the end of the compression stroke, which cannot be used in the following work cycle to accelerate a piston from the top dead center to the bottom dead center. By way of example, the cam curve of the brake cam 12 of the engine braking device according to the invention depicted in FIGS. 2 to 13 has two lifts. The lifts are designed as brake lifts and/or reloading lifts. The valve train 36 depicted in FIGS. 2 to 14 is executed as a 2-stroke engine brake with recharging. Naturally, the valve train 36 can also be executed as a 4-stroke engine brake with only one brake lift and an optional recharging lift. The function and effect of brake and recharging cams will not be discussed in detail as they are sufficiently known from prior art.

The valve train 36 has a cam follower 13 assigned to the firing cam 11, which is provided for actuating the gas exchange valves 15, 16 in a firing mode. Furthermore, the valve train 36 has a cam follower 14 assigned to the braking cam 12, which is provided for actuating one of the gas exchange valves 15, 16 in braking operation. In the shown exemplary embodiment according to FIGS. 2 to 14, only the gas exchange valve 16 is actuated in the braking mode. The cam follower 13, which is provided for the firing mode, is only provided for an active connection with the firing cam 11. The cam follower 14, which is provided for braking operation, is only provided for active connection with the braking cam 12.

In addition, the valve train 36 has a changeover device 17, which is provided to changeover between the firing mode and the braking mode. The changeover device 17 is provided to changeover between an actuation of both gas exchange valves 15, 16 by the firing cam 11 and an actuation of the individual gas exchange valve 16 by the braking cam 12. The changeover device 17 is provided for switching back and forth between a tapping of the cam curve of the firing cam 11 by the assigned cam follower 13 and a tapping of the cam curve of the brake cam 12 by the assigned cam follower 14. The changeover device 17 is only provided for switching the actuation of the gas exchange valves 15, 16 of the one cylinder. For the other cylinders, the valve train 36 can in principle have further, analogously designed changeover devices.

The valve train 36 comprises two rocker arms 22, 23 assigned to the cylinder. The cam followers 13, 14 are assigned to the rocker arms 22, 23. The engine braking device comprises two rocker arms 22, 23, each having one of the cam followers 13, 14. The rocker arms 22, 23 can each be pivoted about a rocker arm shaft 24, 25 fixed by a rocker arm bearing 21 to actuate the gas exchange valves 15, 16. One rocker arm 22 is provided for the firing mode and has the cam follower 13, which is provided for the active connection with the firing cam 11. The other rocker arm 23 is provided for the braking mode and has the cam follower 14, which is provided for the active connection with the brake cam 12. The rocker arm 22, which is provided for the firing mode, acts on both gas exchange valves 15, 16. In the depicted exemplary embodiment, the rocker arm 23, which is provided for the braking mode, only acts on one gas exchange valve 16, but can in principle also act on both gas exchange valves 15, 16. In the shown exemplary embodiment according to FIGS. 1 to 14, the rocker arm 23 acts on the gas exchange valve 16 in the braking mode via a slide shoe 37, which can be moved longitudinally and is mounted in the rocker arm 22. The two rocker arms 22, 23 are separated from each other moveably. Depending on whether the firing mode or the braking mode is switched, the camshaft 10 actuates the corresponding rocker arm 22, 23, while the other rocker arm 22, 23 is decoupled from the camshaft 10.

The firing cam 11 is positioned substantially centrally between the two gas exchange valves 15, 16 in axial extension on the camshaft. Furthermore, the rocker arm 22 is split at its end opposite the cam follower 13, such that each of the two ends 22.1, 22.2 of the rocker arm 22 can actuate one of the two gas exchange valves 15, 16. The end 22.1 of the rocker arm 22 assigned to the gas exchange valve 15 is in direct contact with the gas exchange valve 15, while the end 22.1 of the rocker arm 22 assigned to the gas exchange valve 16 can act on the gas exchange valve 16 via the slide shoe 37. For this purpose, the end 22.1 has a hole 22.3 in which the slide shoe 37 is accommodated in a longitudinally moveable manner. The slide shoe 37 has a head 37.1 which is connected to a shaft 37.3 via a ledge 37.2. The shaft 37.3 is accommodated in the hole 22.3 in a longitudinally moveable manner, wherein the end 22.2 of the rocker arm 22 is supported on the ledge 37.2 during a stroke movement of the rocker arm 22 in the firing mode and transmits the stroke of the firing cam 11 to the gas exchange valve 16 via the head 37.1. A cap 54 can be provided between the head 37.1 and the gas exchange valve 16, which is placed on one end 16.1 of the gas exchange valve 16. The slide shoe 37 can have a securing element 37.4 on its shaft 37.3 opposite the head 37.1, which prevents the slide shoe 37 from falling out of the hole 22.3 when the rocker arm 22 is mounted. Advantageously, due to the central arrangement of the firing cam 11 between the two gas exchange valves 15, 16, the bifurcated rocker arm 22 is designed substantially symmetrically in relation to the two ends 22.1, 22.2 of the rocker arm 22 and the firing cam 11, such that the two ends 22.1, 22.2 substantially have the same distance from the firing cam 11, whereby an even load of the rocker arm 22 is enabled and a tilting moment along the camshaft 10 is avoided.

The braking cam 12 is positioned at a distance from the firing cam 11 on the camshaft 10 substantially in alignment with the gas exchange valve 16 perpendicular to the axis of rotation 40 of the camshaft 10. In this way, the rocker arm 23 can be designed to be substantially straight, such that an input of lateral forces on the valve train 36 can be avoided, whereby a low-wear operation is possible. In the braking operation, the rocker arm 23 acts as a stroke of the braking cam 12 via a transmission element 55 on the end 23.1 of the rocker arm 23 on the slide shoe 37. The transmission element 55 is firmly connected to the rocker arm 23. The longitudinally moveable slide shoe 37 slides in the hole 22.3 of the rocker arm 22, which is not actuated in the braking mode, when the stroke of the braking cam 12 is transmitted in the direction of the gas valve 16 and back.

The changeover device 17 is provided to convert a torque of the camshaft 10 into a force for switching between the firing mode and the braking mode. For control by means of a control and regulating device which is not depicted in more detail, the changeover device 17 comprises an actuator which is not depicted in more detail, by means of which the changeover can be triggered. Apart from the actuator, which is only provided for triggering the changeover, the changeover device 17 is completely mechanical.

The camshaft 10 has a separate switching cam 20. The switching cam 20 is different from the firing cam 11 and the braking cam 12. The switching cam 20 is axially moveable relative to the firing cam 11 and the braking cam 12 and forms a separate cam contour 18. The switching cam 20 rotates with the camshaft 10. The switching cam 20 is assigned to the changeover device 17. The switching cam 20 forms an active part of the changeover device 17. The switching cam 20 is coupled to the actuator which is not further visible and which is provided for triggering the changeover. The actuator is controlled by a not further visible computing unit of the changeover device 17. The computing unit of the changeover device 17 is formed by a part of the vehicle electronics of the motor vehicle 33. Via the actuator, the switching cam 20 can be moved axially along the camshaft 10. For this purpose, the switching cam 20 is guided in a longitudinal groove 10.1 of the camshaft 10. To enable the switching cam 20 to move along the camshaft 10, the camshaft 10 can be substantially tubular and forms a cavity 10.2. The longitudinal groove 10.1 penetrates the camshaft 10, wherein the switching cam 20 is accommodated in the longitudinal groove 10.1 with a positioning element 20.1. In the cavity 10.2 of the camshaft 10, for example, an actuator can act on the positioning element 20.1 and move the switching cam 20 in the longitudinal groove 10.1. The switching cam 20 has two switching positions, wherein a first switching position is assigned to a firing mode and a second switching position is assigned to a braking mode. In at least one operating state, the cam contour 18 of the switching cam 20 is provided to act directly on a switching element 19 of the changeover device 17, which is provided for direct changeover between the firing mode and the braking mode. The changeover device 17 has the switching element 19. The switching element 19 is rotatably mounted, wherein the valve train 36 is in the firing mode or in the braking mode, depending on a rotational position of the switching element 19. The switching cam 20 is provided for a direct rotation of the switching element 19. The switching element 19 is rotated by the rotation of the camshaft 10. One bearing axis 41 of the switching element 19 extends in parallel to the rotation axis 40 of the camshaft 10. The bearing axis 41 of the switching element 19 is arranged next to the rotation axis 40 of the camshaft 10. To rotate the switching element 19, the switching element 19 is contacted by the switching cam 20 and rotated directly.

Figure 2:
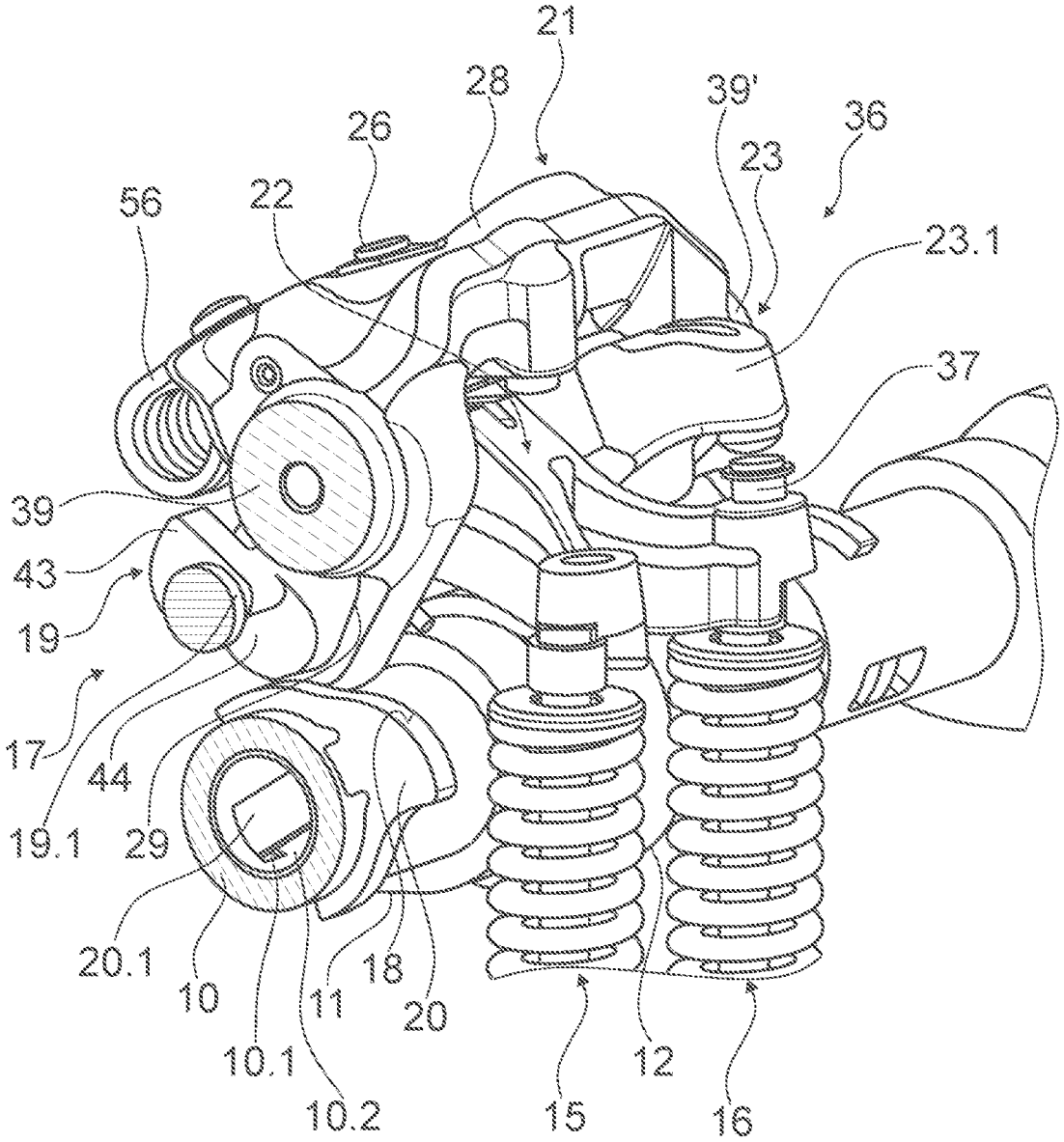
FIG. 2 is a perspective depiction of the valve train according to the invention in a firing mode from the front.
Figure 3:
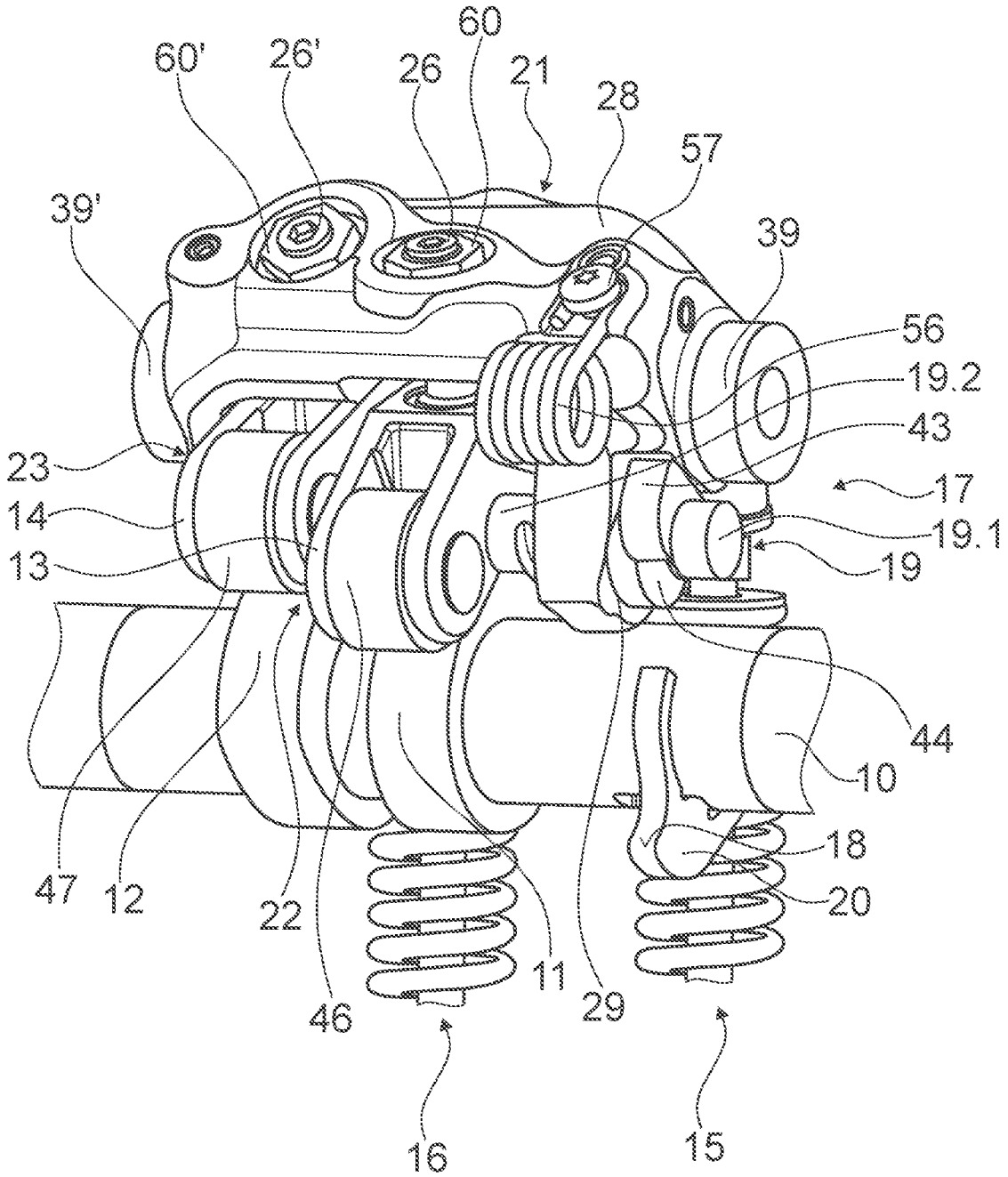
FIG. 3 is a perspective depiction of the valve train according to the invention in a firing mode from behind.
Figure 4:
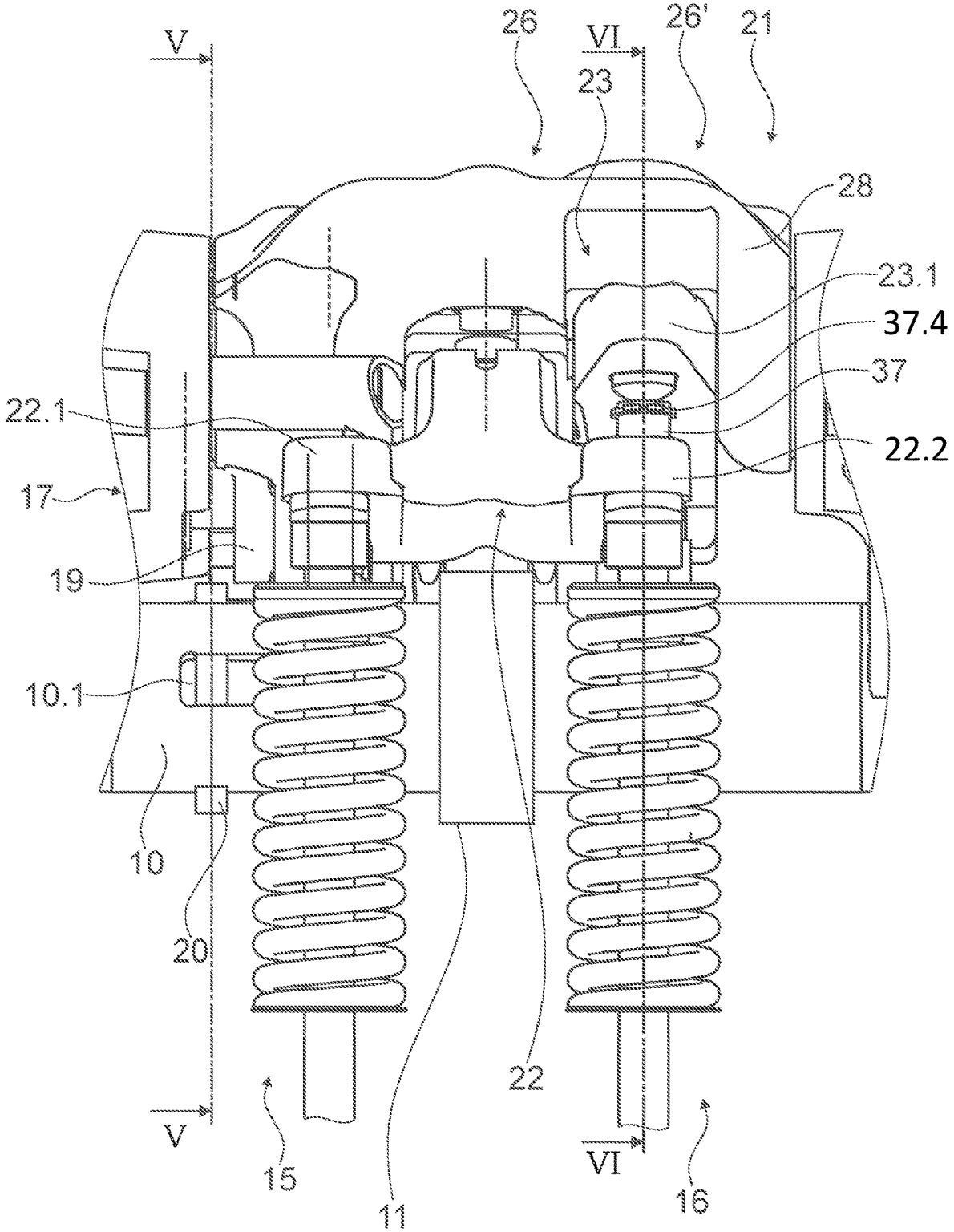
FIG. 4 illustrates the valve train in a firing mode in a front view.
Figure 5:
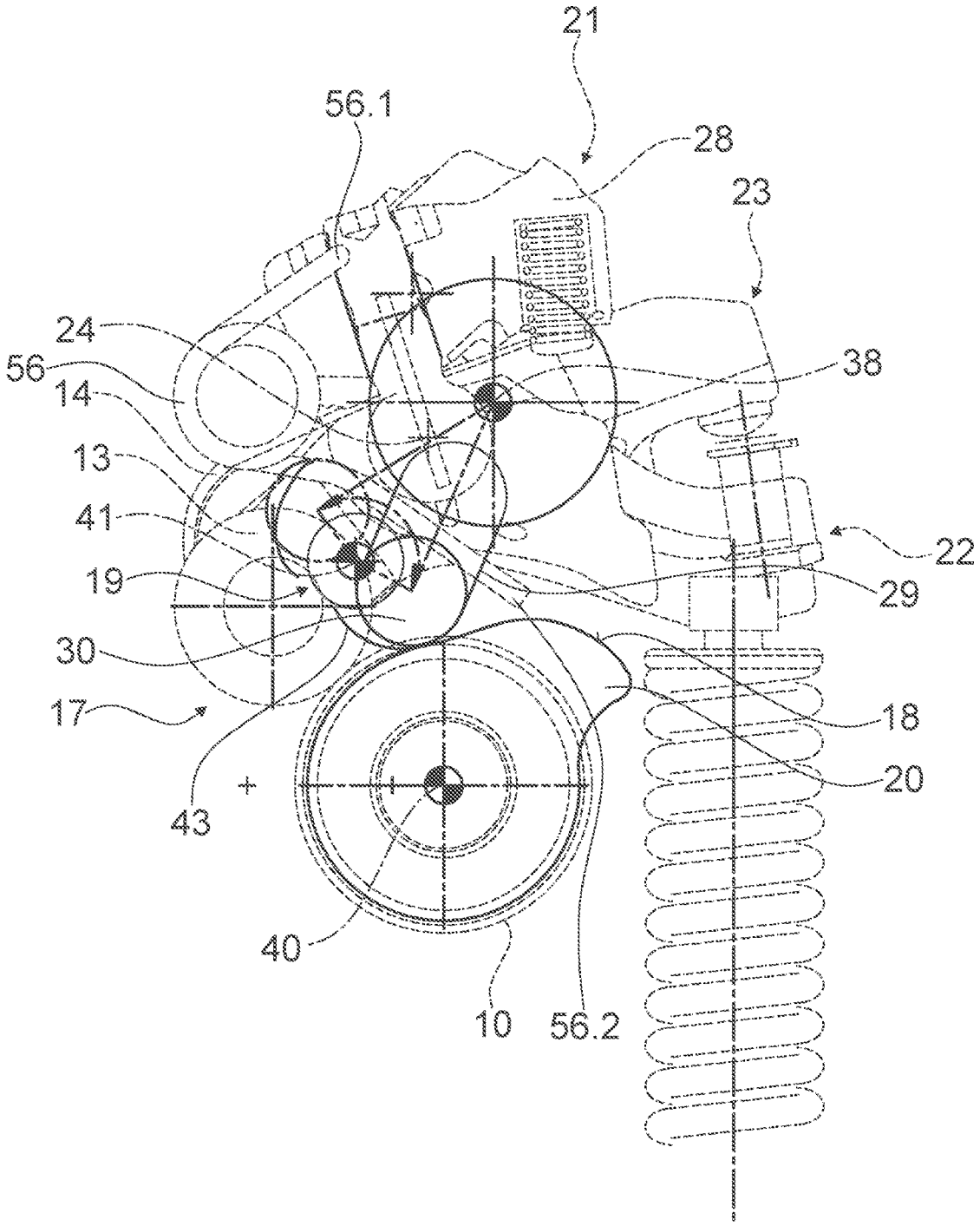
FIG. 5 is a partial section of the valve train in a firing mode in a cross-section along the intersection V-V.
Figure 7:
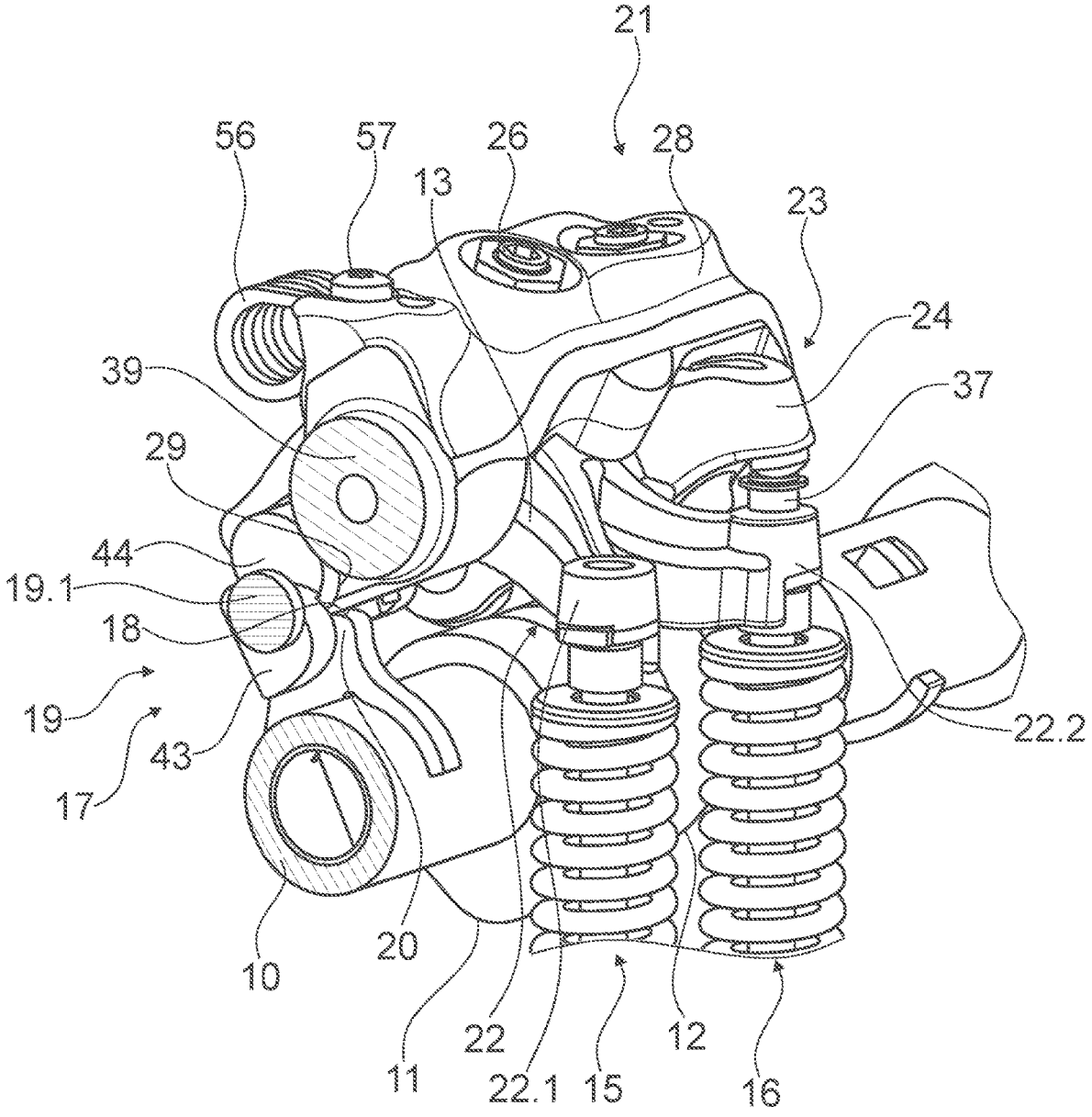
FIG. 7 is a perspective depiction of the valve train according to the invention in a braking mode from the front.
Figure 8:
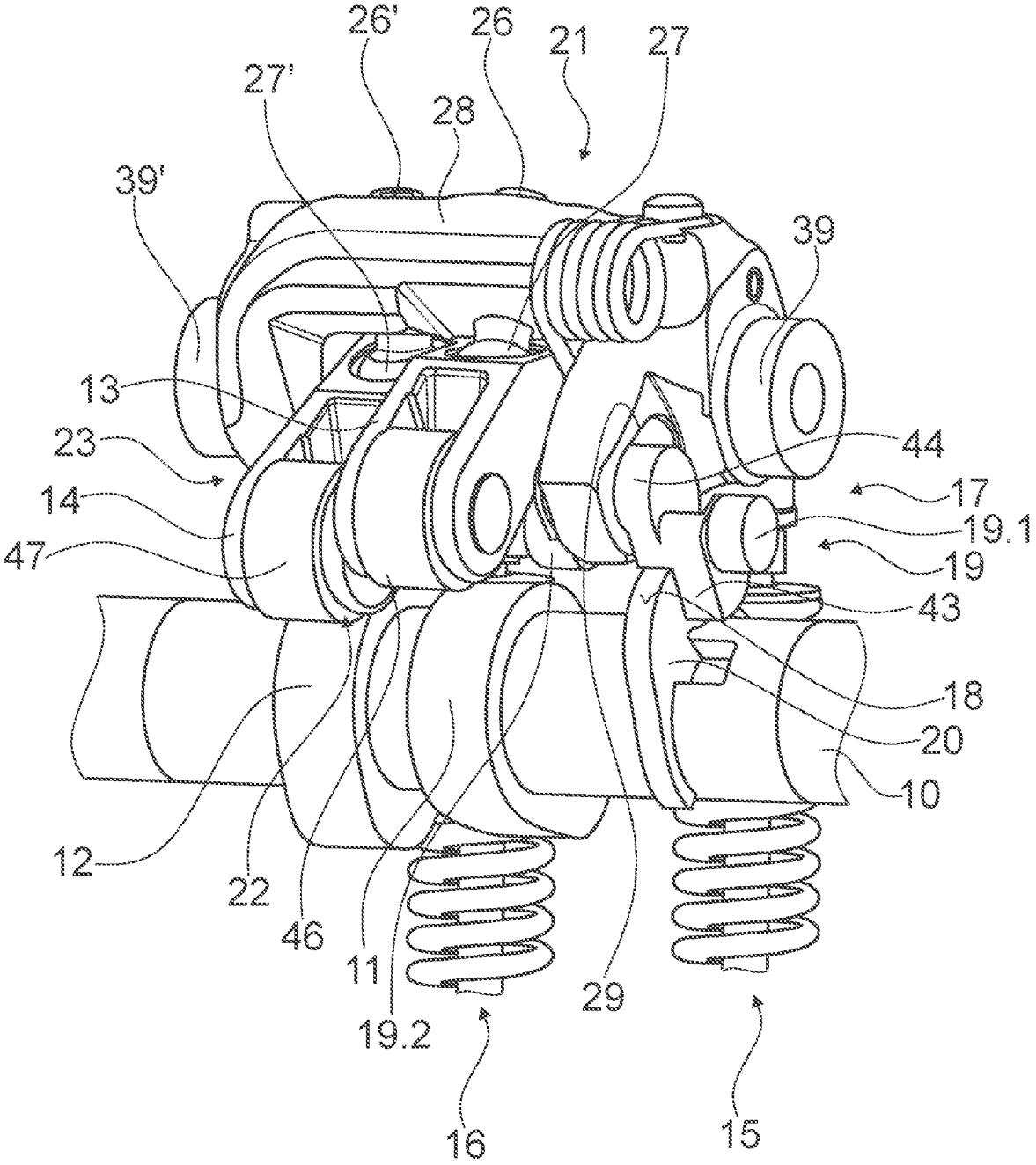
FIG. 8 is a perspective depiction of the valve train according to the invention in a braking mode from behind.
Figure 9:
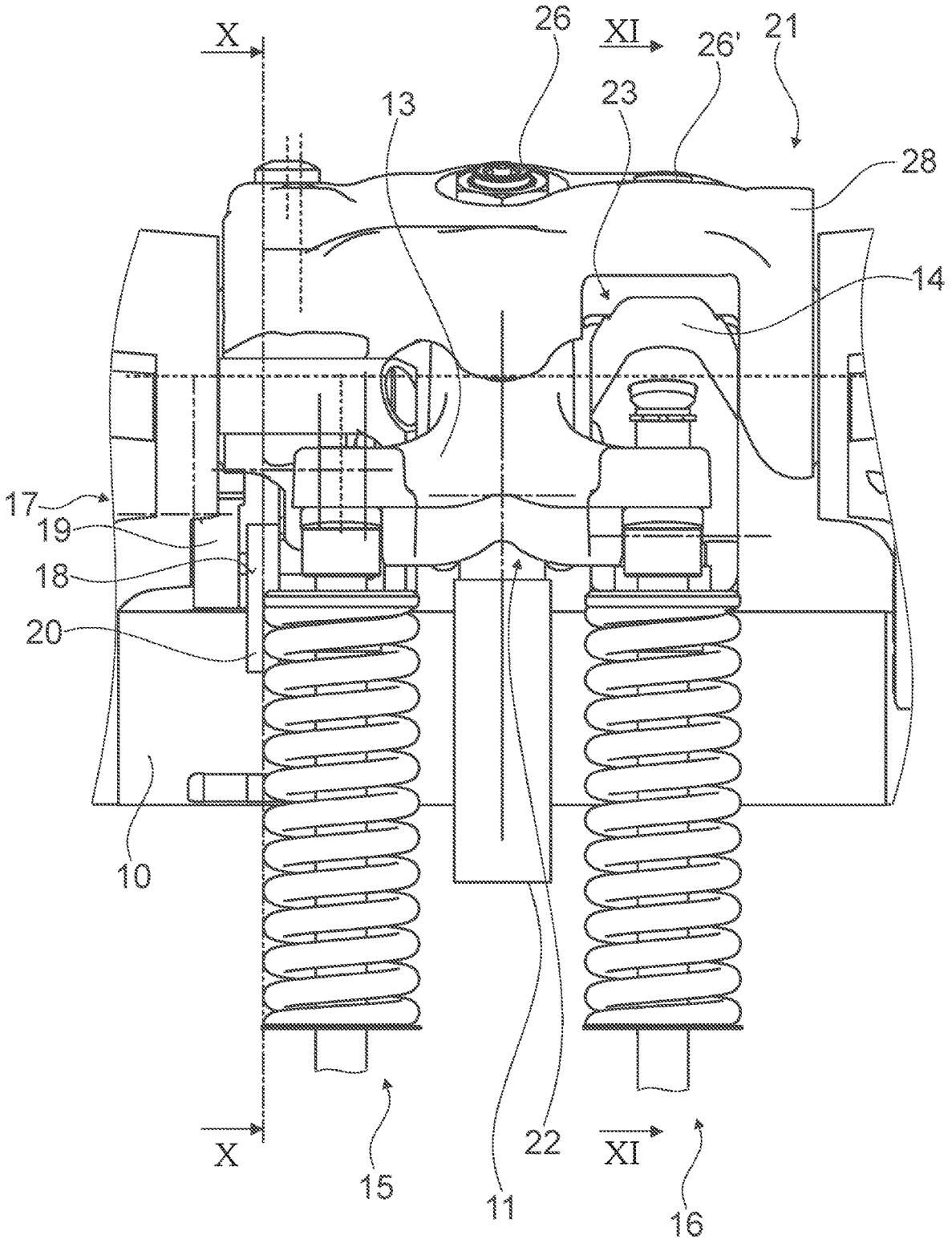
FIG. 9 illustrates the valve train in a braking mode in a front view.
Figure 10:
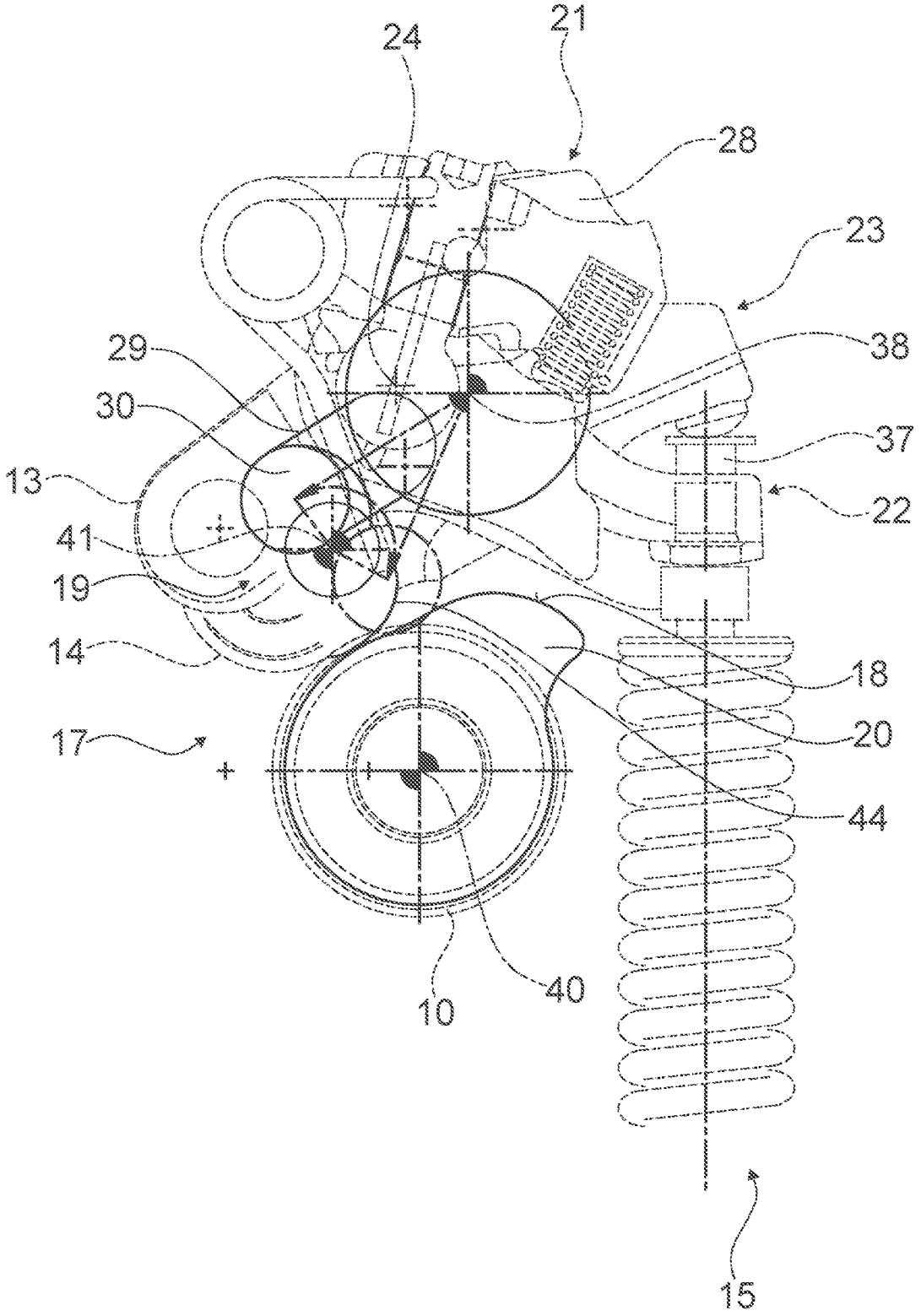
FIG. 10 is a partial section of the valve train in a braking mode in a cross-section along the intersection X-X.
Figure 13:
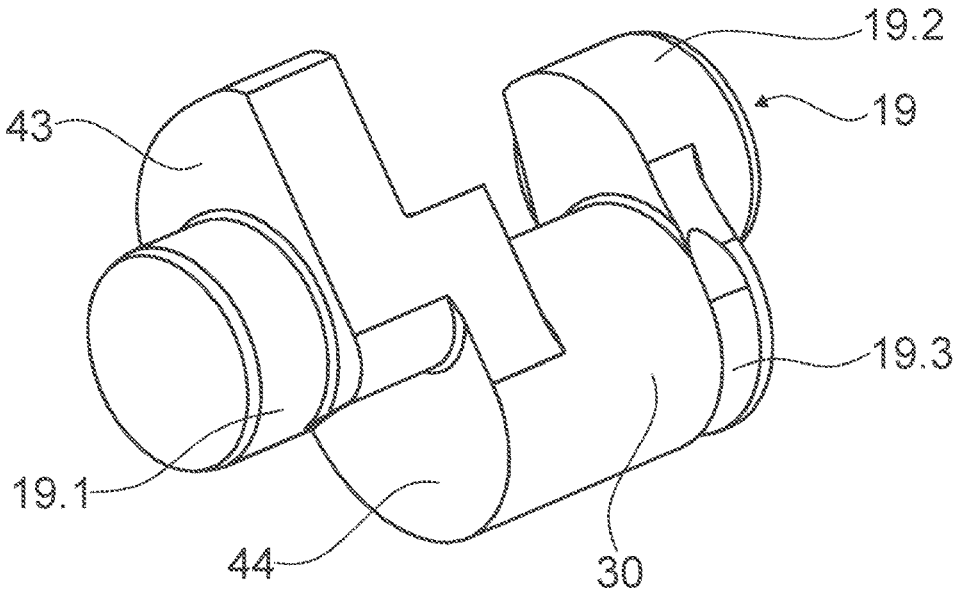
FIG. 13 illustrates a switching element of the changeover device of the valve train according to the invention in a perspective depiction.

The switching element 19 of the changeover device 17 is formed by a switching eccentric shaft. The switching element 19 has a switching section 30 which is eccentric in relation to the bearing axis 41. For this purpose, the switching element 19 is designed like a crankshaft in the region of the eccentric switching section 30. Furthermore, the switching element 19 has two changeover cams 43, 44, which are provided for adjusting the switching element 19. The first changeover cam 43 is assigned to the firing mode and the second changeover cam 44 is assigned to the braking mode. The changeover cams 43, 44 are arranged directly next to each other. In principle, however, it would also be conceivable that the changeover cams 43, 44 are spaced apart. The first changeover cam 43 is located in a plane perpendicular to the rotation axis 40 of the camshaft 10, in which the switching cam 20 is also located in the first switching position. The second changeover cam 44 is arranged in a plane perpendicular to the rotation axis 40 of the camshaft 10, in which the switching cam 20 is also located in the second switching position. The switching element 19 is adjusted via the changeover cams 43, 44, wherein the switching element 19 in turn is provided to transmit a switching movement further via the eccentric switching section 30. If the switching cam 20 is in a first switching position and if the valve train 35 is in a braking mode, the first changeover cam 43 is in an orbit of the switching cam 20 and is contacted during one rotation of the switching cam 20 and pushed out of an orbit of the switching cam 20. The switching element 19 is brought into a firing mode position. If the switching cam 20 is in a first switching position and the valve drive 36 is in a firing mode, the switching cam 20 and the first changeover cam 43 are contactless. If the switching cam 20 is in a second switching position and the valve train 36 is in a firing mode, the second changeover cam 44 is in an orbit of the switching cam 20 and is contacted during one rotation of the switching cam 20 and pushed out of an orbit of the switching cam 20. The switching element 19 is brought into a braking mode position. If the switching cam 20 is in a second switching position and the valve train 36 is in a braking mode, the switching cam 20 and the second changeover cam 44 are contactless (FIGS. 2, 7 and 13).

Furthermore, the changeover device 17 has a rocker arm bearing 21 directly coupled to the switching element 19, which has a first end position assigned to the firing mode and a second end position assigned to the braking mode. The rocker arm bearing 21 is provided for the changeover of the active connection between the camshaft 10 and the cam followers 13, 14. The rocker arm bearing 21 serves in particular to bear the rocker arms 22, 23 and determines the rocker arm axis 24 for the rocker arm 22 and the rocker arm axis 24, which is different from the rocker arm axis 25, for the rocker arm 23 respectively, about which the corresponding rocker arm 22, 23 is pivotably mounted. The rocker arm axes 24, 25 run parallel to the rotation axis 40 of the camshaft 10 (FIGS. 2 to 11).

The rocker arm bearing 21 comprises a pivotably mounted bearing element 28. The rocker arm bearing 21 comprises a bearing element 28, on which the rocker arms 22, 23 are mounted (see FIGS. 2, 7 and 12). The bearing element 28 itself is pivotably mounted. A bearing axis 38, about which the bearing element 28 can be pivoted, is arranged in parallel to the rocker arm axes 24, 25. The rocker arm axis 24 and the rocker arm axis 25 are offset at an angle to each other about the bearing axis 38 of the bearing element 28. The bearing element 28 is mounted in a housing, which is not depicted in more detail, of the valve train 36. The housing is attached to the cylinder head. The bearing element 28 is executed in the form of a U-shaped bracket, wherein ends 39, 39' of the bearing element 28, which are oriented parallel to the axis of rotation 40 of the camshaft 10, serve for bearing about the bearing axis 38, and wherein the rocker arms 22, 23 are connected to a part of the bearing element 28 which is substantially parallel to the camshaft 10. The ends 39, 39' of the bearing element 28 are designed in the form of bearing pins and are rotatably accommodated in bearings of the housing which are not further visible. Furthermore, the switching element 19 has two opposite ends 19.1, 19.2. The ends 19.1, 19.2 of the switching element 19 are also designed in the form of bearing pins and are rotatably accommodated in further bearings of the housing which are not further visible. The camshaft 10 is also rotatably accommodated in other bearings of the housing which are not further visible. It is also conceivable that the camshaft is rotatably mounted in the cylinder head in a known manner and the remaining components of the valve train 36 are accommodated in the housing connected to the cylinder head.

The bearing axis 38 of the bearing element 28 is oriented in parallel offset to the rotation axis 40 of the camshaft 10. In the first end position, the cam follower 13 provided for the firing mode is in constant contact with the firing cam 11. On the other hand, the cam follower 14 provided for the braking mode is lifted off the brake cam 12, whereby the braking cam 12 passes under the cam follower 14 without effect (FIGS. 2 to 6). Conversely, in the second end position, the cam follower 14 for the braking mode is in constant contact with the braking cam 12, while the cam follower 13 for the firing mode is lifted from the firing cam 11, whereby the firing cam 11 passes under the cam follower 13 without effect. By swivelling the bearing element 28 from one end position to the other end position, the position of the respective rocker arm axes 24, 25 relative to the rotation axis 40 of the camshaft 10 is changed. While the one rocker arm axis 24, 25 and the associated rocker arm 22, 23 is closer to the rotation axis 40 of the camshaft 10 in one end position and ensures contact between one cam follower 13, 14 and the respective cam 11, 12, the other rocker arm axis 24, 25 and the associated rocker arm 22, 23 in the same end position of the bearing element 28 further away from the axis of rotation 40 of the camshaft 10, whereby there is no contact between the other cam follower 13, 14 and the respective cam 11, 12 (FIGS. 7 to 11).

A swivel movement of the bearing element 28 is limited by the two mechanical stops which define the two end positions of the rocker arm bearing 21. During a swivel movement of the bearing element 28 from the second end position in the braking mode to the first end position in the firing mode, the stops limit the swivel movement of the bearing element 28. Accordingly, the stops limit the swivel movement of the bearing element 28 from the first end position in the firing mode to the second end position in the braking mode.

To limit the swivel movement of the bearing element 28, the bearing element 28 of the rocker arm bearing 21 has a switching gate 29. The switching gate 29 extends perpendicularly to the bearing axis 38 of the bearing element 28. The shifting gate 29 is formed by a straight, elongated recess. In principle, however, a different design, which would appear sensible to a person skilled in the art, would also be conceivable. The eccentric switching section 30 of the switching element 19 of the changeover device 17 is guided in the switching gate 29. One position of the bearing element 28 is set via the switching gate 29. Depending on a rotational position of the switching element 19, the bearing element 28 is in the first end position or the second end position. Depending on a rotational position of the switching element 19, the eccentric switching section 30 is accordingly located at a first end of the switching gate 29 or at the second end of the switching gate 29. When the switching element 19 is rotated, the eccentric switching section 30 slides through the switching gate 29 from one end to the other, wherein the bearing element 28 is rotated from one end position to the other end position (cf. FIGS. 3, 5, 8, 10 and 12).

To secure the end positions, the valve drive 36 has a retaining spring 56. One end of the retaining spring 56.1 is attached to the bearing element 28 by means of a retaining element 57. The retaining element 57 can be designed in a suitable manner, for example, in the form of a head screw. The retaining spring 56 applies a spring tension starting from the bearing element 28 in the direction of the switching section 30. For this purpose, the retaining spring 56 rests with its other end 56.2 in a groove 19.3 of the switching section 30. The groove 19.3 is substantially provided between the bearing element and the switching section 30, wherein, by means of the spring force of the retaining spring 56, the switching section 30 is retained at the first end of the switching gate 29 or at the second end of the switching gate 29, depending on the rotational position of the switching element 19. The retaining spring 56 is designed in the form of a torsion spring, wherein other forms or a retaining spring are also conceivable.

The groove 19.3 is provided as an at least partially peripheral groove on the end of the switching section 30 opposite the changeover cam 43. The switching section 30 is substantially designed in the form of a cylinder, wherein the switching section 30 merges at least partially into the changeover cam 43.

The adjustment of the engine brake device is therefore not represented by a locking mechanism and the torque required for the adjustment from the bearing forces and the eccentric offset of the rocker arms 22, 23, but rather by a kinematic coupling of the switching element 19 and the bearing element 28 in such a way that the separate cam contour 18 acts on the switching element 19, which causes a rotation of the bearing element 28 in the sense of a single step of a Geneva drive. Thus the movement of the switching element 19 is directly coupled to the movement of the bearing element 28. Furthermore, the presence of a separate switching cam 20 means that the switching time point is no longer coupled to the exhaust cam elevation, but rather can be selected at will, which represents a significant degree of freedom in terms of cam design. The energy required for the switching operation comes from the camshaft 10, wherein here it is not the firing cam 11 which is applied via the rocker arm 22, but rather via the switching cam 20 itself. The triggering is represented by an axial movement of the switching cam 20 in the camshaft 10. In the depicted embodiment of the switching operation of an electro-mechanically operated decompression engine brake, the changeover process is depicted with the separate switching cam 20, which is located on the camshaft 10, and the switching element 19, which acts as a link between the camshaft housing and the rotatably mounted bearing element 28. By means of the arrangement of the switching cam 20 and the switching element 19, a kinematic coupling between the rotational camshaft movement, in particular exhaust camshaft movement, and the rotation of the bearing element 28 is produced, and the dependency of the switching movement on the exhaust valve lift is thus eliminated.

Furthermore, the rocker arm bearing 21 has two bearing screws 26, 26' The bearing screws 26, 26' each have a ball head 27, 27' for bearing the rocker arms 22, 23 which can be pivoted about the rocker arm axis 24, 25. The bearing screws 26, 26' are each assigned to one of the rocker arms 22, 23 and serve to bear the rocker arms 22, 23 on the bearing element 28. The bearing screws 26, 26' are designed identically. In principle, however, an at least partially differentiating design would also be conceivable. The bearing screws 26, 26' are each formed by a spherical head screw. A geometrical center of the ball head 27, 27' defines the rocker arm axis 24, 25 of the respective rocker arm 22, 23 in each case. The ball heads 27, 27' of the bearing screws 26, 26' each form a ball joint together with a ball head receptacle 58' of the associated rocker arm 22, 23 via which the corresponding rocker arm 22, 23 is mounted on the rocker arm bearing 21. The bearing screws 26, 26' therefore represent the fixed bearing pin of the ball head 27, 27', i.e., the outer ball, and the respective rocker arm 22, 23 the ball head receptacle 58'. The ball head receptacle 58' has a circumferential groove 58.1' on its upper edge, in which a circlip 58.2' can be inserted. The circlip 58.2' prevents the ball head 27, 27' from loosening from the ball head receptacle 58'. The rotatably mounted bearing element 28 is provided to accommodate the bearing screws 26, 26'. The bearing screws 26, 26' are each designed for limited adjustment of the valve clearance relative to the bearing element 28. The bearing screws 26, 26' are screwed into the bearing element 28, wherein a screw-in depth can be changed. By means of a screw-in depth, the rocker arm axis 24, 25 of the respective rocker arm 22, 23 can be changed relative to the bearing element 28 and a valve clearance can thereby be adjusted. To prevent rotation, the bearing screws 26, 26' can each be secured or locked by means of a locknut 60, 60' against unwanted rotation in the bearing element 28. In order to carry out the adjustment of the valve clearance, the bearing center of the rocker arm 22, 23, i.e., the rocker arm axis 24, 25 is shifted by means of the respective bearing screws 26, 26' in such a way that the distance from the respective rocker arm 22, 23 to the camshaft 10 and the valve-sided tap varies.

The bearing screws 26, 26' each have an oil channel 31. The oil channels 31 are each provided to provide an engine-side pressure oil supply 48 on the respective rocker arm 22, 23, depending on the position of the respective bearing screws 26, 26' relative to the respective rocker arm 22, 23. The oil channels 31 are each provided to provide the engine-side pressure oil supply 48 at oil demand points of the respectively associated rocker arm 22, 23, such as a rocker arm roller 46, 47 of the cam followers 13, 14, across which the rocker arm 22, 23 slides on the firing cam 11 or the braking cam 12, or the contact point between the slide shoe 37 and the gas exchange valve 16. The bearing screws 26, 26' each produce a connection between the engine-side pressure oil supply 48 and rocker arm-side oil demand points of the rocker arm roller 46, 47 and the valve-side slide shoe contact. The bearing screws 26, 26' are rotated relative to the rocker arms 22, 23 when the operating modes of fired and braked modes are adjusted, which allows the oil flow to be controlled by the design of the oil hole position. This in turn reduces the total oil requirement for the rocker arms 22, 23 to the rocker arms 22, 23 activated in the respective operating mode. The rocker arms 22, 23, which are therefore not required in the current operating mode, are excluded from an oil supply. This can occur in particular without additional valves.

Figure 6:
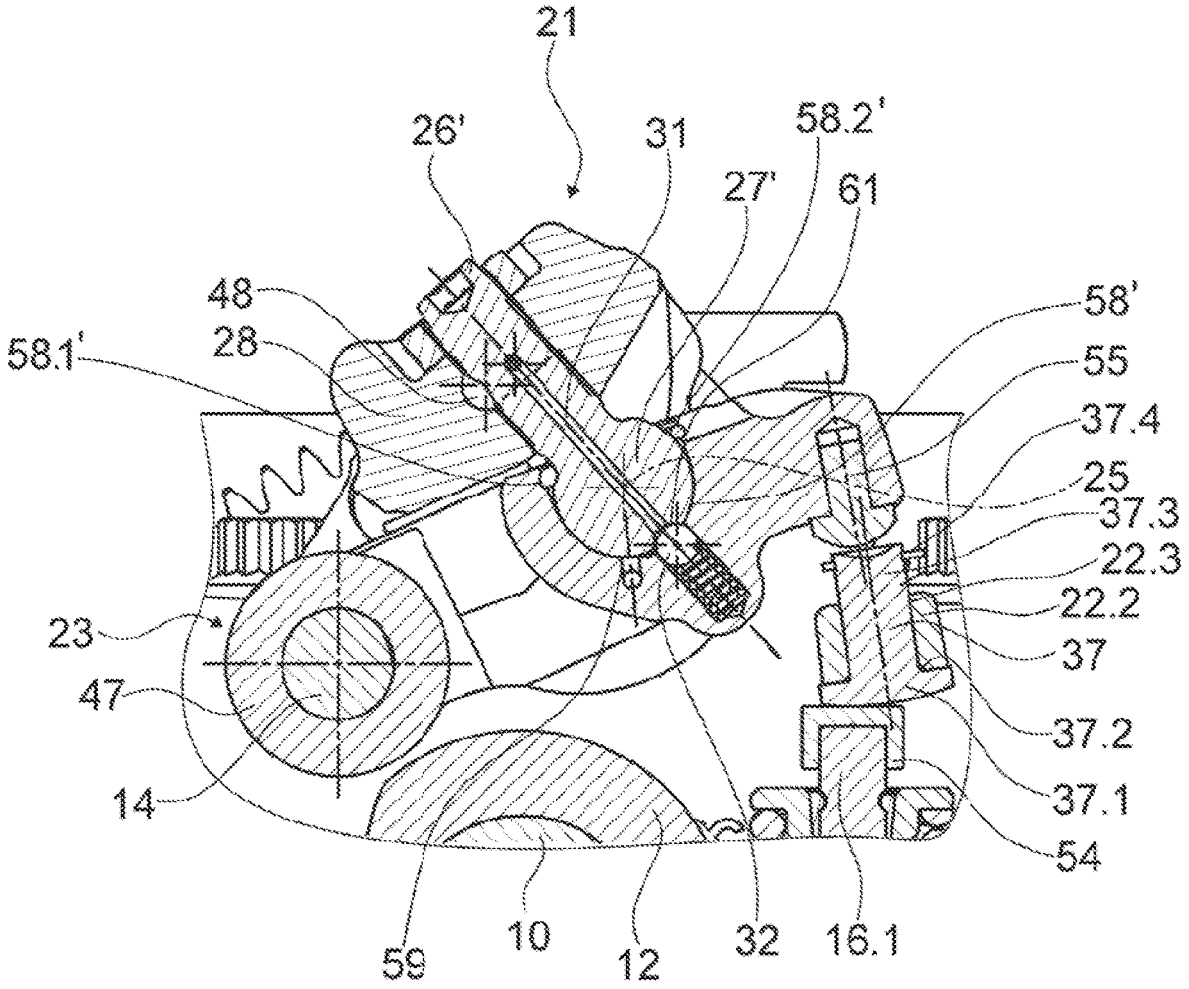
FIG. 6 illustrates the valve train in a firing mode in a cross-section along the intersection VI-VI.
Figure 11:
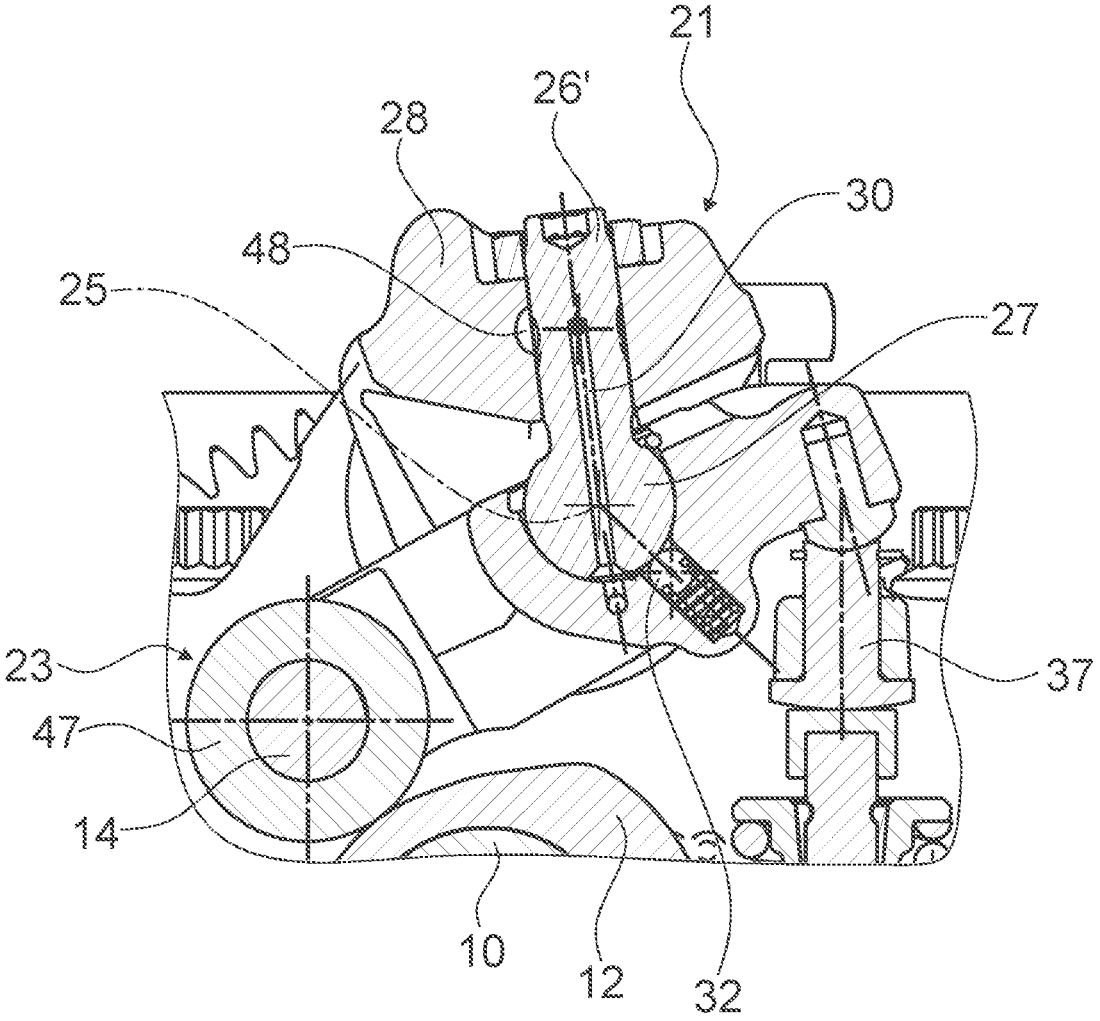
FIG. 11 illustrates the valve train in a braking mode in a cross-section along the intersection XI-XI.
Figure 12:
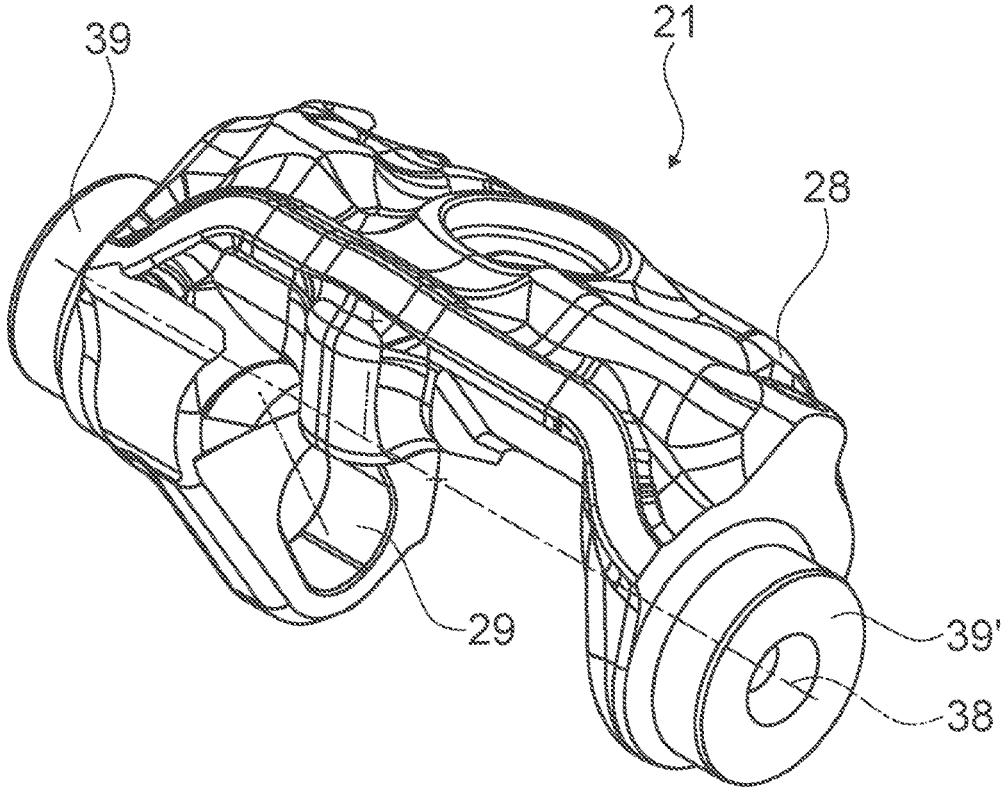
FIG. 12 illustrates a bearing element of a rocker arm bearing of a changeover device of the valve train according to the invention in a perspective depiction.

FIGS. 6 and 11 show, by way of example, the oil supply of the rocker arms depending on the operating mode of the internal combustion engine 35. Both Figures show a sectional view of the rocker arm 23. In FIG. 6, the bearing element 28 is depicted in its end position for the fired mode. Here, the rocker arm 22, which is not shown, transfers a stroke of the firing cam 11 to the gas exchange valves 15, 16. With its cam follower 14, the shown rocker arm 23 has no contact with the braking cam 12 and is therefore not moved. The pressure oil supply 48 is still connected to the oil channel 31 in the bearing screw 26'. By rotating the bearing screw 26' to the rocker arm 23, a connection to an oil supply line 59 to the oil demand points is interrupted. The oil supply line 59 is provided in the ball head receptacle 58' substantially opposite the bearing screw 26, 26'. In FIG. 11, the bearing element 28 is depicted in its end position for the braked mode. Here, the rocker arm 22, which is not shown, does not transmit a stroke of the firing cam 11 to the gas exchange valves 15, 16, while, with its cam follower 14, the shown rocker arm 23 is in contact with the braking cam 12 and thus transmits a stroke of the braking cam 12 to the gas exchange valve 16. The pressure oil supply 48 is connected to the oil channel 31 in the bearing screw 26' and the oil channel 31 overlaps the oil supply line 59. In order to ensure sufficient overlap or alignment of the oil channel 31 and the oil supply line 59 when the rocker arm 23 is moved and thus to enable a constant oil supply during a tilting movement of the rocker arm 23, the bearing screw 26' on the end of the oil channel 31 has a conical extension 61 of the oil channel 31 opening outwards at its ball head 27. The rocker arm 22 for the fired mode is designed analogously to the rocker arm 23.

In addition, the rocker arm 23 has an arresting element 32 for the braking mode. The arresting element 32 is provided for arresting the associated rocker arm 23 relative to the rocker arm bearing 21 in at least one position. The arresting element 32 is provided for arresting the rocker 23 for the braking mode relative to the respectively assigned bearing screw 26' in a deactivated or fired mode. The arresting element 32 is provided to arrest the rocker arm 23 in a firing mode (FIG. 6). The arresting element 32 is formed by a spring-loaded ball facing the assigned bearing screws 26'. The arresting element 32 is provided next to the oil supply line 59 in the rocker arm 22, 23 in the ball head receptacle 58'.

In principle, however, a different design, which would appear sensible to a person skilled in the art, would also be conceivable. The arresting of the arresting element 32 can be released non-destructively when a defined release force is applied by the switching cam 20, which exceeds an arresting force. The arresting element 32 is provided to hold the rocker arm bearing 21 in the first end position respectively. The arresting element 32 is directly integrated in the ball joint between the bearing screws 26' and the rocker arm 23 (see FIGS. 6 and 11).

The arresting element 32 is also provided to shut off an oil flow of the oil channel 31 of the bearing screw 26' in an arrested condition. One end of the oil channel 31 facing the rocker arm 23 is directly covered by the ball of the arresting element 32. The arresting element 32 is provided to engage in the oil channel 31 of the bearing screw 26' in an arrested condition. The oil flow is shut off and arrested by the engagement. The conical extension 61 of the oil channel 31, which opens outwards, forms a corresponding dwell cone on the end facing the rocker arm 23. The arresting element 32 therefore simultaneously stops the oil flow in the engaged position and releases it again in the activated position (see FIGS. 6 and 11).

The rocker arm 22 for the fired mode is designed analogously to the rocker arm 23.

Figure 14:
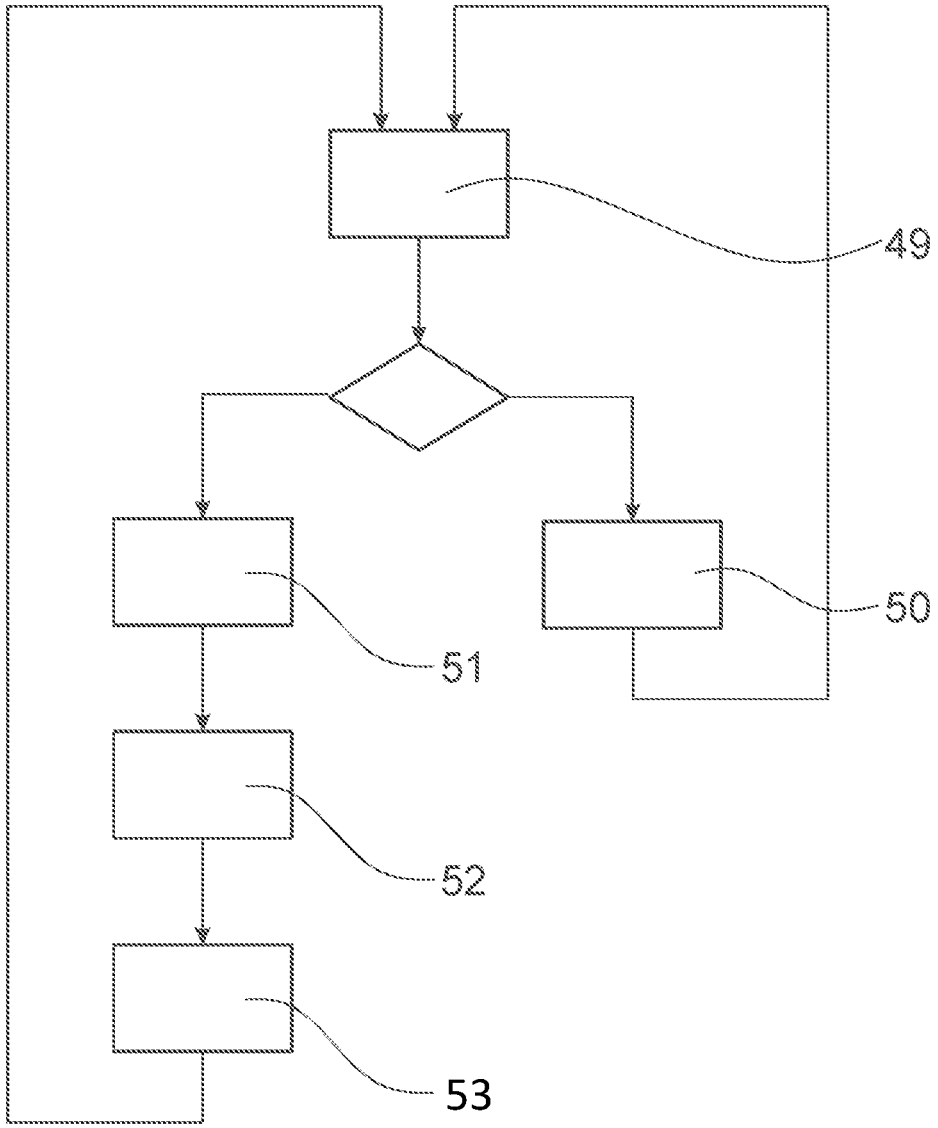
FIG. 14 is a schematic flow chart of a method for operating the valve train according to the invention.

FIG. 14 shows a flow chart of a method for operating the valve train 36. The method is analogous to the description and functioning of the valve train 36 which has already been explained. In the method, a direct changeover between the firing mode and the braking mode is effected directly on the switching element 19 of the changeover device 17 by means of the separate cam contour 18 of a camshaft 10 of the valve train 36. In the method, in a first method step 49, the switching cam 20 is brought into a switching position corresponding to the desired operating state, i.e., a braking mode or a firing mode. If the valve train 36 is already in the corresponding operating state, the switching cam 20 and the switching element 19 are contactless in the further method step 50. If the valve train 36 is not yet in the corresponding operating state, the switching cam 20 contacts the corresponding changeover cam 43, 44 of the switching element 19, which is located in the same plane, in a second method step 51 during a rotation of the camshaft 10 and rotates the switching element 19 correspondingly. Due to the rotation of the switching element 19, the bearing element 28 changes the end position in a third method step 52. Subsequently, by tilting the bearing element 28 in a fourth method step 53, the rocker arm 22, 23, which previously made contact with the assigned firing cam 11 or the braking cam 12, is lifted off the assigned firing cam 11 or braking cam 12, and the rocker arm 22, 23, which was previously lifted off the associated firing cam 11 or braking cam 12, is pressed against the associated firing cam 11 or braking cam 12. Subsequently, a changeover between the firing mode and the braking mode has taken place and the first method step 49 can be repeated.

LIST OF REFERENCE CHARACTERS

10 camshaft
10.1 longitudinal groove
10.2 cavity
11 firing cam
12 braking cam
13 cam follower
14 cam follower
15 gas exchange valve
16 gas exchange valve
16.1 end
17 changeover device
18 cam contour
19 switching element
19.1 end
19.2 end
19.3 groove
20 switching cam
20.1 positioning element
21 rocker arm bearing
22 rocker arm
22.1 end
22.2 end
22.3 hole
23 rocker arm
23.1 end
24 rocker arm axis
25 rocker arm axis
26 bearing screw
27 ball head
28 bearing element
29 switching gate
30 switching section
31 oil channel
32 arresting element
33 motor vehicle
34 drive wheel
35 internal combustion engine
36 valve train
37 slide shoe
37.1 head
37.2 ledge
37.3 shaft
37.4 securing element
38 bearing axis
39 end
40 rotation axis
41 bearing axis
43 changeover cam
44 changeover cam
45 rocker arm roller
46 rocker arm roller
47 rocker arm roller
48 pressure oil supply
49 method step
50 method step
51 method step
52 method step
53 method step
54 cap
55 transmission element
56 retaining spring
56.1 end
56.2 end
57 retaining element
58' ball head receptacle
58.1' groove
58.2' circlip
59 oil supply line
60 locknut
61 extension

The invention claimed is:

1. A valve train, comprising:

a camshaft which has a cam group including a firing cam and a braking cam;

a first cam follower assigned to the firing cam, wherein the first cam follower in a firing mode actuates a gas exchange valve;

a second cam follower assigned to the braking cam, wherein the second cam follower in a braking mode actuates the gas exchange valve;

a changeover device with a switching element, wherein the changeover device changes over between the firing mode and the braking mode; and a switching cam which, in an operating state, acts directly on the switching element of the changeover device and provides for a direct changeover between the firing mode and the braking mode;

wherein the switching element of the changeover device has a switching section which is eccentric in relation to a bearing axis of the switching element and wherein the switching cam is configured to directly rotate the switching element.

2. The valve train according to claim 1, wherein the switching cam is axially displaceable relative to the firing cam and the braking cam and forms a cam contour.

3. The valve train according to claim 1, wherein the changeover device has a rocker arm bearing which is coupled directly to the switching element and has a first end position assigned to the firing mode and a second end position assigned to the braking mode.

4. The valve train according to claim 3 further comprising two rocker arms each having one of the first and second cam followers and wherein each of the two rocker arms are pivotable about a rocker arm axis set by the rocker arm bearing for actuating the gas exchange valve.

5. The valve train according to claim 4, wherein the rocker arm bearing has a bearing screw having a ball head for bearing pivotably about the rocker arm axis.

6. The valve train according to claim 5, wherein the rocker arm bearing has a rotatably mounted bearing element for receiving the bearing screw, wherein the bearing screw is adjustable relative to the rotatably mounted bearing element for setting a valve clearance.

7. The valve train according to claim 6, wherein the rotatably mounted bearing element has a switching gate in which the eccentric switching section of the switching element is guided.

8. The valve train according to claim 5, wherein the bearing screw has an oil channel.

9. The valve train according to claim 8, wherein at least one of the two rocker arms has an arresting element and wherein the at least one of the two rocker arms is arrestable by the arresting element relative to the rocker arm bearing.

10. The valve train according to claim 9, wherein the arresting element shuts off an oil flow of the oil channel in an arrested state.

11. A method for operating the valve train of claim 1, comprising the step of:

directly acting on the switching element of the changeover device for a direct changeover between the firing mode and the braking mode by the switching cam.

* * * * *